United States Patent [19]

Furukawa

[11] Patent Number: 4,538,967

[45] Date of Patent: Sep. 3, 1985

[54] BLOWER

[75] Inventor: Kenji Furukawa, Konan, Japan

[73] Assignee: Diesel Kiki Co., Ltd., Tokyo, Japan

[21] Appl. No.: 486,510

[22] Filed: Apr. 19, 1983

[30] Foreign Application Priority Data

Apr. 30, 1982 [JP] Japan ..... 57-63959[U]

[51] Int. Cl.[3] ..... F04B 17/00; F04B 35/04

[52] U.S. Cl. ..... 417/360; 417/423 R; 403/349

[58] Field of Search ..... 417/360, 361, 410, 423 R, 417/424, 350, 363, 366, 423 A; 403/348, 349, 288; 285/362, 377, 361; 310/89

[56] References Cited

U.S. PATENT DOCUMENTS

| | | | |
|---|---|---|---|
| 1,803,847 | 5/1931 | Ellis | 220/297 |
| 2,134,142 | 10/1938 | Orear | 417/423 R |
| 2,695,747 | 11/1954 | Miller | 417/360 |
| 2,886,127 | 5/1959 | Brock | 417/424 |
| 3,154,242 | 10/1964 | Harris | 417/360 |
| 3,744,635 | 7/1973 | Horvath | 417/424 |
| 3,802,804 | 4/1974 | Zimmermann | 417/360 |
| 3,963,381 | 6/1976 | Kohnen | 417/360 |
| 4,053,262 | 10/1977 | Horvath | 417/424 |
| 4,339,054 | 7/1982 | Kellogg | 220/295 |
| 4,403,923 | 9/1983 | Korchin | 417/360 |

*Primary Examiner*—Cornelius J. Husar
*Assistant Examiner*—Peter M. Cuomo
*Attorney, Agent, or Firm*—Frishauf, Holtz, Goodman & Woodward

[57] ABSTRACT

A blower casing has a through hole formed in an end face, through which extends a motor which is drivingly coupled to a fan. An annular fitting flange member is rigidly fitted on the outer peripheral surface of the motor and joined at its peripheral edge to a portion of the above end face of the casing surrounding the through hole, for mounting the motor on the casing. The above through hole of the casing has its inner peripheral surface formed with an annular ridge which sealingly abuts against an opposed outer peripheral surface of the fitting flange member.

5 Claims, 4 Drawing Figures

BLOWER

BACKGROUND OF THE INVENTION

This invention relates to blowers adapted primarily for use in air conditioning systems, and more particularly to sealing means for sealing a clearance between a fitting flange for coupling the motor to the casing and the same casing.

A conventional blower for use in air conditioning systems mainly comprises a casing, a fan accommodated within the casing, and a motor coupled to the fan for rotatively driving same. The motor is disposed to penetrate a through hole formed in a rear end of the casing. An annular fitting flange member is rigidly fitted on the motor and joined at its outer peripheral edge to the rear end face of the casing to rigidly couple the motor to the casing.

In such conventional blower, sealing means is provided for sealing the clearance between the fitting flange member and the casing, which is formed by discrete members formed of a material such as urethane. Such discrete or separately formed sealing members are applied between the fitting flange member and the casing when the blower is assembled. Therefore, it does not only require preparing such discrete sealing members, but also requires application of such sealing members to the sealing places each time each blower is assembled. Thus, it takes much time to assemble the blower.

SUMMARY OF THE INVENTION

It is an object of the invention to provide a blower for air conditioning systems, which is provided with sealing means formed integrally on the casing to supersede the aforementioned special discrete sealing members, thereby being reduced in the number of component parts and curtailing the time required for the assemblage, that is, for the mounting of the motor onto the casing.

It is a further object of the invention to provide a blower for air conditioners, which can obtain accurate centering of the motor with respect to the casing with ease, thereby achieving the supply of a required amount of blown air, with accuracy.

The present invention provides a blower including a casing having a through hole formed in one end face thereof, a main body having a fan accommodated within the casing and a motor drivingly coupled to the fan and extending through the above through hole of the casing, and an annular flange member fitted and rigidly secured on the motor and joined at its outer peripheral edge to a portion of the one end face of the casing surrounding the through hole. The blower is characterized in that the above through hole of the casing has its inner peripheral surface formed with an annular ridge extending through its whole circumference. The annular ridge has its tip disposed in sealing contact with an outer peripheral surface of the flange member to thereby seal the clearance between the flange member and the casing.

The above and other objects, features and advantages of the invention will be more apparent from the ensuing detailed description taken in connection with the accompanying drawings.

DETAILED DESCRIPTION

Figure 1:
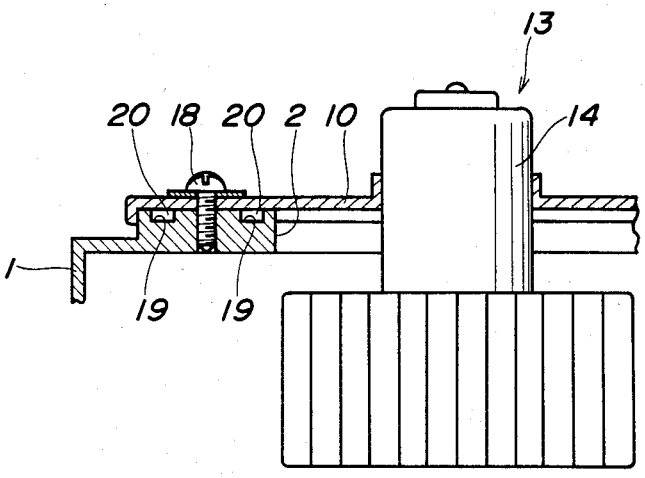
FIG. 1 PRIOR ART
FIG. 1 is a side view of a conventional blower, partly in longitudinal section, particularly showing in detail sealing means arranged between a fitting flange member and a blower casing.

Referring first to FIG. 1, there is illustrated a conventional blower, by way of example. A casing 1 of the blower has a through hole 2 formed in its rear end face, through which a motor 14 forming part of the main body 13 of the blower extends with a half thereof projected to the outside. An annular fitting flange member 10 is fitted and rigidly secured on the motor 14 and has its outer peripheral edge abutting against a peripheral portion of the rear end face of the casing 1 surrounding the through hole 2 and secured thereto by means of screws 18 to thus couple the blower main body 13 to the casing 1. A peripheral portion of the rear end face of the casing 1 surrounding the through hole 2 and abutting on the fitting flange member 10 is formed with two inner and outer annular recesses or grooves 19 and 19 extending concentrically with the through hole 2 of the casing 1. These grooves 19, 19 are filled with sealing members 20 and 20 formed of urethane or a like material to seal the clearance between the casing 1 and the fitting flange member 10.

However, according to such sealing means, special discrete or separately formed sealing members 20, 20 are required. In addition, in mounting the blower main body 13 onto the casing 1, these sealing members 20, 20 have to be fitted into the grooves 19, 19 in the casing 1, requiring much trouble and much time.

Figure 2:
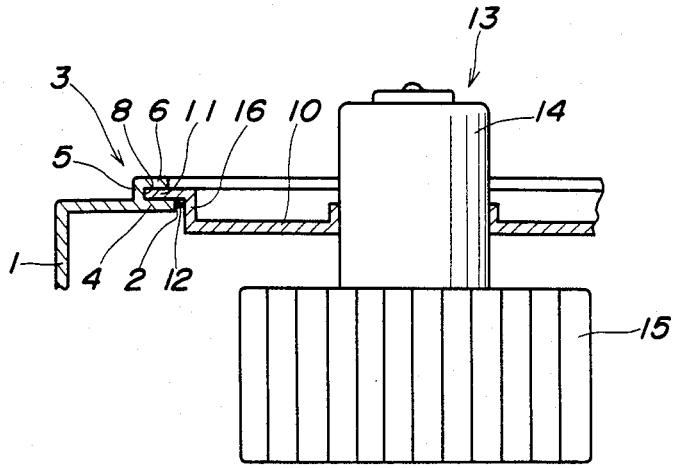
FIG. 2 is a view similar to FIG. 1, showing a blower according to one embodiment of the present invention.
Figure 3:
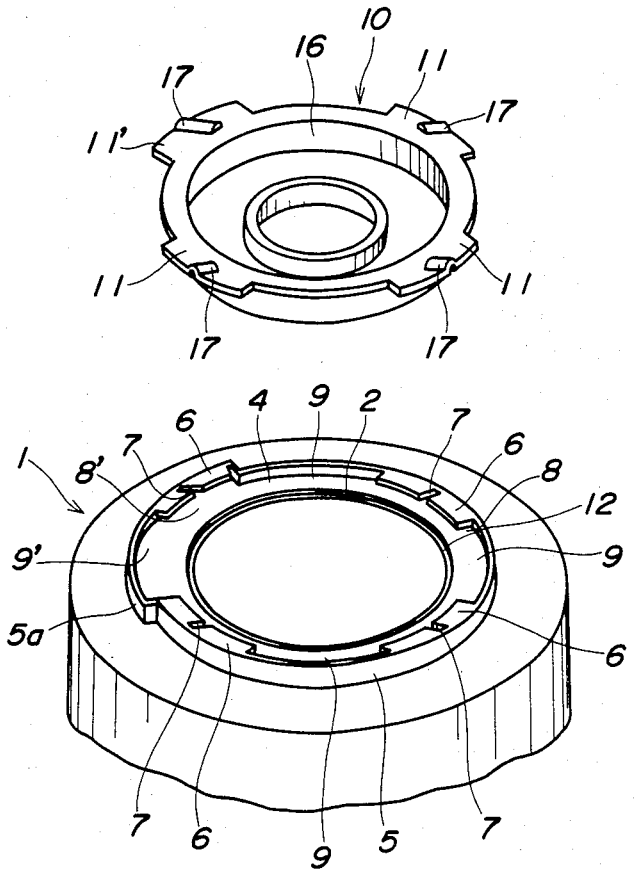
FIG. 3 is an exploded perspective view of the fitting flange member and casing of the blower shown in FIG. 2.
Figure 4:
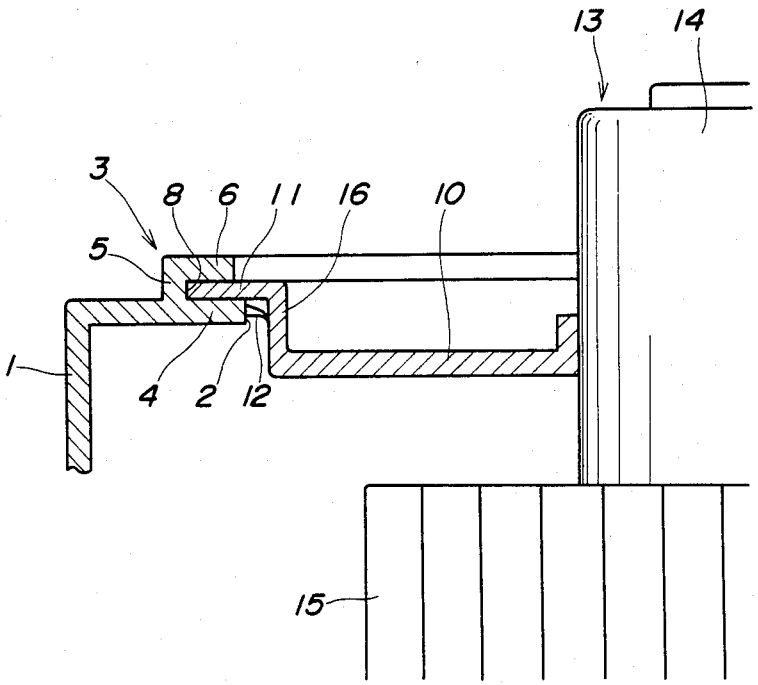
FIG. 4 is an enlarged side view, partly in longitudinal section, of essential parts of the blower of FIG. 2.

FIGS. 2 through 4 illustrate a blower according to a preferred embodiment of the present invention. The casing 1 has a through hole 2 formed in a central portion of its rear end face and a joint 3 formed at an outer peripheral portion of the same rear end face surrounding the same through hole 12. The joint 3 comprises an end face peripheral edge portion 4 extending radially outward from the through hole 2, an annular wall 5 axially projected from a radially outward peripheral edge of the peripheral edge portion 4 in concentricity with the through hole 2, and four first engaging protuberances 6, each in the form of a plate, formed on a peripheral end edge of the peripheral wall 5 remote from the peripheral edge portion 4, at circumferentially equal intervals and radially inwardly extending toward the center of the through hole 2. An engaging recess 8, 8' is defined between each of the first engaging protuberances 6, the peripheral wall 5, and the end face peripheral edge portion 4. Part **5*a* of the peripheral wall 5 is projected in the radially outward direction, providing a slightly larger diameter than the rest of the peripheral wall 5, and accordingly the engaging recess 8' defined at this part 5*a* is located at a larger distance from the center of the through hole 12 than the other engaging recesses 8. Each of the first engaging protuberances 6 has a radial recessed groove 7** formed in its outside surface at a substantially circumferential center.

At locations intermediate between adjacent engaging recesses 8 and 8, axially outwardly opening guide portions 9, 9' are defined between the peripheral wall 5 and the end face peripheral edge portion 4. These guide portions 9, 9' serve as guides for second engaging protuberances 11 of the fitting flange 10, hereinafter referred to, until the latter become engaged with the respective engaging recesses 8, 8'. One 9' of the guide portions is located at a larger distance from the center of the through hole 2 than the other guide portions 9, because it is adjacent the engaging recess 8' within the outwardly projected part 5*a* of the peripheral wall 5.

The through hole 2 of the blower casing 1 has its inner peripheral surface formed with an annular ridge 12 having a triangular section, extending through the whole circumference and projected inward toward the center of the through hole 12. This annular ridge 12 has its tip disposed in resiliently urging contact with an opposed outer peripheral surface of the fitting flange member 10, as described later. The annular ridge 12 may be applied to the inner peripheral surface of the through hole 2, after being formed from a separate material from that of the casing 1, as in the illustrated embodiment. Alternatively, it may be formed integrally with the casing 1 from a single-piece material.

The main body 13 of the blower comprises a motor 14 and a fan 15 secured on an output shaft, not shown, of the motor 14. The motor 14 is disposed to penetrate through the through hole 2 of the casing 1 with its rear half projected to the outside, and carries an annular fitting flange member 10 fitted and rigidly secured on its outer peripheral surface.

The fitting flange member 10 has its outer peripheral edge formed integrally with a peripheral wall 16 axially extending through its whole circumference. The peripheral wall 16 has its outer peripheral surface confronting the tip of the annular ridge 12 of the casing 1 and disposed in resiliently urging contact therewith to seal the clearance between the fitting flange 10 and the casing 1.

The peripheral wall 16 has an end remote from the flange main body and forming an outer peripheral edge of the flange member 10, which is formed integrally with four second engaging protuberances 11, 11' radially outwardly extending and arranged at circumferentially equal intervals of 90 degrees, which are each fitted in a corresponding one of the engaging recesses 8 of the casing 1. One 11' of the second engaging protuberances has a larger radial size than those of the others, with its outer peripheral edge located more radially outward than the others, so as to align with the radially outwardly located engaging protuberances 8' of the casing 1. That is, this second engaging recess 11' and its corresponding engaging recess 8' cooperatively serve as locating means for locating the blower main body 13 into a predetermined circumferential position in the casing 1.

Each of the second engaging protuberances 11, 11' has its outside surface formed with a radial fitting projection 17 for fitting in the fitting recessed groove 7 in the corresponding first engaging protuberance 6, to lock the fitting flange member 10 in place in the blower casing 1.

With the above arrangement, to mount the blower main body 13 onto the casing 1, first, the fitting flange member 10 is fitted onto the motor 14 of the main body 13 and rigidly secured thereto by means of force fitting or by other suitable means, and then the main body 13 is inserted through the through hole 2 of the casing 1 with its fan 15 located ahead. Then, the locating second engaging protuberance 11' of the fitting flange member 10 is brought into alignment with the locating guide portion 9' of the joint 3 of the casing 1. Next, the tip of the annular ridge 12 on the inner peripheral surface of the through hole 2 of the casing 1 comes into resiliently urging contact with the outer peripheral surface of the peripheral wall 16 of the fitting flange member 10, in such a manner that it is suitably deformed toward the interior of the casing 1, as clearly shown in FIG. 4, to seal the clearance between the fitting flange member 10 and the casing 1. Further, due to the resiliency of the annular ridge 12, the blower main body 13 is automatically centered in the through hole 12 or has its axis aligned with the center of the through hole 12. After this, the fitting flange member 10 is rotated clockwise as viewed in FIG. 3 so that the fitting projection 17 of each second engaging protuberance 11, 11' slidingly moves circumferentially on the inside surface of the corresponding first engaging protuberance 6 of the fitting portion 3, while simultaneously forcing the same protuberance 6 to be axially outwardly elastically deformed, until the projection 17 becomes engaged in the fitting groove 7 of the first engaging protuberance 6, thus engaging each of the second engaging protuberance 11, 11' within the corresponding engaging recess 8, 8' to couple the blower main body 13 to the casing 1.

Although in the illustrated embodiment the fitting flange member 10 is retained on the casing 1 by means of the engagement of the first engaging protuberances 6 formed with the fitting grooves 7 with the second engaging protuberances 11, 11' formed with the fitting projections 17, the invention is not limited to this retaining means. For instance, it may be formed by means which couples the fitting flange member to the casing by means of screw-threaded engagement.

As described above, according to the invention, since the annular ridge 12 previously formed on the inner peripheral surface of the through hole 2 in the casing 1 automatically comes into sealing contact with the outer peripheral surface of the fitting flange member 10 when the flange member is mounted on the casing 1, no special discrete or separate sealing member is required, and the time for assembling the blower is greatly reduced. Further, due to the automatic centering of the blower main body with respect to the casing, an accurate required amount of blown air can be obtained, and also, the width of the annular ridge 12 can be made small, facilitating the operation of forming or machining the annular ridge.

Having described a specific embodiment of the invention, it is to be understood that any variations will occur to those skilled in the art within the scope of the appended claims.

What is claimed is:

1. In a blower including a casing having a through hole formed in one end face thereof, said through hole extending axially of said casing and having an inner peripheral surface, a main body including a fan arranged to be received within said casing through said through hole, and a motor drivingly coupled to said fan and extending axially through said through hole of the casing, said motor having a portion thereof arranged within said casing and the rest thereof outside said casing, a radially extending annular flange member fitted and rigidly secured on said motor and joined at an outer peripheral edge thereof to a portion of said one end face of said casing surrounding said through hole, said annular flange member having an outer peripheral surface, a first engaging half comprising an annular wall axially projected on said one end face and surrounding said through hole in concentricity therewith, a plurality of first engaging protuberances extending radially inwardly from said annular wall and circumferentially spaced from each other, each of said first engaging protuberances cooperating with said annular wall and a portion of said one end face surrounding said through hole to define an engaging recess therebetween, a second engaging half comprising a plurality of second engaging protuberances projecting radially outwardly from said annular flange member at an outer peripheral edge thereof and circumferentially spaced from each other, and retaining means for retaining said second engaging half on said first engaging half in predetermined positional relation thereto, wherein each of said second engaging protuberances of said second engaging half is fitted in said engaging recess corresponding thereto to couple said annular flange member to said casing, the improvement comprising:

an annular ridge located on and secured to said inner peripheral surface of said through hole of said casing and extending about a whole circumference thereof, said annular ridge having a tip thereof facing radially inwardly of said through hole and having resiliency, said annular ridge having said radially inward tip disposed in urging contact with said outer peripheral surface of said annular flange member so that a resilient force of said annular ridge is applied to said outer peripheral surface of said annular flange member in a direction substantially at right angles with the axis of said through hole, to seal a clearance between said annular flange member and said casing; part of said annular wall of said first engaging half being projected more radially outward than the rest thereof and including at least one of said first engaging protuberances, at least one of said second engaging protuberances of said second engaging half corresponding to said at least one first engaging protuberance being correspondingly projected more radially outward than the other second engaging protuberances, said at least one second protuberance cooperating with said at least one first protuberance to locate said annular flange member in a predetermined circumferential position relative to said casing.

2. A blower as claimed in claim 1, wherein said annular ridge has a substantially triangular section.

3. A blower as claimed in claim 1, wherein said annular ridge is formed of a member formed separately from said casing.

4. A blower as claimed in claim 1, wherein said annular ridge is formed integrally with said casing in a single piece.

5. A blower as recited in claim 1, wherein said retaining means comprises a fitting projection formed on each of said second engaging protuberances, and a fitting recess formed in each of said first engaging protuberances.

* * * * *

UNITED STATES PATENT AND TRADEMARK OFFICE

CERTIFICATE OF CORRECTION

PATENT NO. : 4,538,967

DATED : September 3, 1985

INVENTOR(S) : Kenji FURUKAWA

It is certified that error appears in the above-identified patent and that said Letters Patent is hereby corrected as shown below:

Column 3, line 37, "casing 1" should read --casing 1,--;

Column 6, line 27 "recited" should read --claimed--.

Signed and Sealed this

*Fourth* Day of *February 1986*

[SEAL]

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,538,967

DATED : September 3, 1985

INVENTOR(S) : Kenji FURUKAWA

It is certified that error appears in the above-identified patent and that said Letters Patent is hereby corrected as shown below:

Column 3, line 52, "protuberances" should read --recess-;

line 53, "recess" should read --protuberance--.

Signed and Sealed this

*Twenty-seventh* Day of *May 1986*

[SEAL]

*Attest:*

DONALD J. QUIGG

*Attesting Officer*

*Commissioner of Patents and Trademarks*